US011698216B2

(12) United States Patent
Blackwood et al.

(10) Patent No.: US 11,698,216 B2
(45) Date of Patent: Jul. 11, 2023

(54) REFRIGERATION SYSTEM WITH ENVELOPING AIR CIRCULATION AROUND PRODUCT CHAMBER

(71) Applicant: STANDEX INTERNATIONAL CORPORATION, Salem, NH (US)

(72) Inventors: Kevin Herrera Blackwood, Summerville, SC (US); Teddy Glen Bostic, Jr., Summerville, SC (US); Gloria Christine Corrine Welther Burchett, Moncks Corner, SC (US); Mark Andrew James, Goose Creek, SC (US); Jonathan Matthew Kolaski, Ridgeville, SC (US); Jeffrey Alan Madill, Summerville, SC (US); John Lee Warder, Summerville, SC (US)

(73) Assignee: Standex International Corporation, Salem, NH (US)

( * ) Notice: Subject to any disclaimer, the term of this patent is extended or adjusted under 35 U.S.C. 154(b) by 0 days.

(21) Appl. No.: 17/588,463

(22) Filed: Jan. 31, 2022

(65) Prior Publication Data

US 2022/0252324 A1 Aug. 11, 2022

Related U.S. Application Data

(60) Provisional application No. 63/147,466, filed on Feb. 9, 2021.

(51) Int. Cl.
*F25D 17/06* (2006.01)
*F25B 13/00* (2006.01)

(52) U.S. Cl.
CPC ..... *F25D 17/062* (2013.01); *F25B 13/00* (2013.01)

(58) Field of Classification Search
CPC ..... F25D 17/062; F25D 17/067; F25D 17/04; F25D 17/06; F25D 21/14;
(Continued)

(56) References Cited

U.S. PATENT DOCUMENTS 8,966,929 B2 3/2015 Rafalovich et al.
9,285,153 B2 3/2016 Contreras LaFaire et al.
(Continued)

FOREIGN PATENT DOCUMENTS

CN 1258838 A * 7/2000 ..... C09K 5/045
EP 2988081 A1 * 2/2016 ..... F25B 39/024

OTHER PUBLICATIONS

Pdf is original document of foreign reference CN 1258838 A (Year: 2000).*

(Continued)

*Primary Examiner* — Len Tran
*Assistant Examiner* — Kamran Tavakoldavani
(74) *Attorney, Agent, or Firm* — Saxton & Stump, LLC

(57) ABSTRACT

A refrigeration system including a storage chamber configured to store a product at a predetermined temperature. The storage chamber is defined by an inner wall. The inner wall at least partially defines an air plenum. The inner wall includes an opening wall surface, a floor surface, a rear wall surface and a ceiling wall surface. The system also includes a refrigerant circuit including a compressor, a condenser, a condenser fan, an evaporator and an evaporator fan arranged and disposed in an operable configuration to provide refrigeration to the storage chamber. The air plenum includes a conduit arranged and disposed to convey air from an air inlet across the evaporator and into a discharge chamber and out an air outlet. The air outlet is configured to discharge cooled air in a direction toward the opening wall surface.

17 Claims, 7 Drawing Sheets

(58) Field of Classification Search
CPC ..... F25D 2317/066; F25D 2317/0666; F25D 2321/144; F25D 2321/1441; F25B 13/00; F25B 39/02; F24F 13/08; F24F 13/082
See application file for complete search history.

(56) References Cited

U.S. PATENT DOCUMENTS

| | | | | |
|---|---|---|---|---|
| 2001/0047660 | A1 | 12/2001 | Mashburn et al. | |
| 2004/0139763 | A1* | 7/2004 | Jeong | F25D 17/062 62/448 |
| 2006/0202596 | A1* | 9/2006 | Bauer | F25D 23/028 312/405 |
| 2009/0019881 | A1 | 1/2009 | Rafalovich et al. | |
| 2012/0060526 | A1* | 3/2012 | May | F25D 29/00 62/115 |
| 2015/0260448 | A1* | 9/2015 | Avila | F25B 49/02 62/157 |
| 2016/0169578 | A1* | 6/2016 | Linney, II | F25D 29/00 62/126 |
| 2017/0074568 | A1* | 3/2017 | Orozco | F25D 17/06 |
| 2017/0261250 | A1* | 9/2017 | Cho | F25D 23/02 |
| 2020/0278136 | A1* | 9/2020 | Olivani | F25B 39/02 |

OTHER PUBLICATIONS

Pdf is translation of foreign reference EP2988081A1 (Year: 2016).*

* cited by examiner

REFRIGERATION SYSTEM WITH ENVELOPING AIR CIRCULATION AROUND PRODUCT CHAMBER

FIELD OF THE INVENTION

The present invention is directed to refrigeration systems particularly for scientific applications, such as, vaccine storage (requirement parameters as defined in the NSF 456-2021 standard), lab specimens, pharmaceuticals, materials testing, blood products storage in addition to commercial and food service applications and other related applications.

BACKGROUND OF THE INVENTION

In scientific refrigeration applications, two important performance parameters used to characterize temperature variation within a refrigerated or environmentally controlled system are temperature stability and temperature uniformity. Temperature stability, as utilized herein, is defined as the largest temperature difference experienced at a single point among all measured points in the refrigerated chamber over a period of time. Temperature uniformity, as utilized herein, is defined as the maximum variation of temperature experienced across all points in the refrigerated chamber at any single point in time during the testing period. In most scientific refrigeration designs, where acceptable operating temperature ranges are generally between 1° C. and 10° C., the airflow coming off the evaporator (cooled air, potentially as low as −10° C. exits the evaporator) is distributed in a diffuse manner, generally directed down the rear wall of the refrigerator opposite the door. In this configuration, the intake fan is generally placed in front of the evaporator and draws air from the front portion of the refrigerator exacerbating the naturally occurring airflow over the warmest surface in the chamber, the door inner wall or inner glass surface in the case of a glass door. This has a number of negative effects on the stability and uniformity of the refrigerated chamber creating a general gradient where the volume at the front-top portion of the chamber remains warmer, the volume directly in the evaporator exhaust remains very cold, and cold air accumulation in the bottom volume of the chamber, as well as other detrimental temperature gradient effects. In addition, since the air exhaust and intake are typically closely located, there can be a high level of recirculation that reduces the overall temperature uniformity. Also, to be considered is the effect of product loading that can block airflow or directly, further exacerbating the above-mentioned detrimental effects and expose product to very cold or very warm regions. Design attempts to better distribute the air utilize plenums in the exhaust path to direct air further into the chamber before exhausting into the chamber. This approach can achieve minor improvements but in general, simply moves the distribution of very cold air while potentially exacerbating the overall temperature variation within the chamber.

FIG. 1 shows a refrigeration system 100 having a conventional vapor cycle refrigeration circuit and airflow arrangement. The refrigeration system 100 shown in FIG. 1 includes an evaporator 101, a compressor 103 and a condenser 105 in a refrigerant circuit to provide cooling to a storage chamber 107. The refrigerant circuit operates to compress and circulate a refrigerant throughout a closed-loop heat transfer fluid circuit connecting the evaporator 101, compressor 103 and condenser 105, to transfer heat away from air in storage chamber 107. The refrigerant is compressed in a compressor 103 from a lower to a higher pressure and delivered to the condenser 105 where the refrigerant is sub-critical and the condenser 105 serves to condense heat transfer fluid from a gas state to a liquid state. Condenser fan 109 is arranged to remove heat from condenser 105 to the ambient environment external from the storage chamber 107 via exhausted air 106. From the condenser 105, high-pressure refrigerant flows to an expansion device (not shown) where it is expanded to a lower pressure and temperature and then is routed to the evaporator 101, where the expanding refrigerant cools the air as the air passes through the evaporator 101. Evaporator fan 111 is arranged to draw air from the storage chamber 107 and across the evaporator 101. From the evaporator 101, refrigerant is returned to the compressor 103. The air discharged from the evaporator 101 and into the storage chamber 107 is directed along a rear wall 113 opposite an opening 115. The resulting airflow 117 includes air circulation within the storage chamber 107. Shelves 119 are arranged in the storage chamber 107 to hold product to be stored in cool storage. This configuration, utilized in most known refrigerators, has numerous inherent problems that work to compound the variances in stability and uniformity characteristics. Specifically, cold air exiting the evaporator chamber can quickly come into contact with product prior to mixing with warmer chamber air. In the arrangement shown in FIG. 1, recirculation can be a problem, especially when product is loaded due to the close proximity of the evaporator air intake and exhaust. The lower volumes can see greatly reduced airflow especially when loaded with product due to the blocking of airflow down the rear wall. The refrigeration system 100 of FIG. 1 suffers from the creation of recirculation eddies due to low velocities (lower front corner) or high velocity, air shear effects (upper front corner). The creation of these recirculation eddies is a detriment to stability and uniformity performance. The induction of airflow that further reinforces flows that are detrimental to well-controlled stability and uniformity characteristics. The rear ejection of the cold air down the rear wall can cause a collection of cold air in the bottom volume and exacerbate the warmer air convecting up the door surface causing a large gradient in the chamber temperature top to bottom, front to back.

It is not found in the prior art a method for creating a circulating envelope of air exhausting from the front, upper portion of the refrigerator that utilizes intrinsic properties of the refrigerator construction to create a stable thermal environment with superior heat capacity utilization, significant reduction of recirculation effects and significant improvement in stability and uniformity performance both in loaded and unloaded situations. It is common, that in order to hold tighter temperature stability and uniformity in systems employing conventional compressors (non-proportional), that the time between cycles must be reduced as a function of the desired minimum and maximum temperature selected. This design best utilizes heat capacity of the refrigerator components in addition to optimization of residual latent heat in the phase change of refrigerant remaining in the evaporator after a refrigeration cycle has ended and the compressor shuts off.

A refrigeration system and refrigeration method that show one or more improvements in comparison to the prior art would be desirable in the art.

BRIEF SUMMARY OF THE INVENTION

The refrigeration system according to the present disclosure provides methodology different than known refrigeration systems for handling airflow, moderating typically warmer volumes, enveloping the refrigerated chamber in a more consistent distribution of homogenized air with the aggregate effect resulting in a system that achieves better stability and uniformity, reducing compressor cycles per day while utilizing conventional compressors at common evaporator temperatures.

In an exemplary embodiment, a refrigeration system is provided. The refrigeration system includes a storage chamber configured to store a product at a predetermined temperature. The storage chamber is defined by an inner wall. The inner wall at least partially defines an air plenum. The inner wall includes an opening wall surface, a floor surface, a rear wall surface and a ceiling wall surface. The system also includes a refrigerant circuit including a compressor, a condenser, a condenser fan, an evaporator and an evaporator fan arranged and disposed in an operable configuration to provide refrigeration to the storage chamber. The air plenum includes a conduit arranged and disposed to convey air from an air inlet across the evaporator and into a discharge chamber and out an air outlet. The air outlet is configured to discharge cooled air in a direction toward the opening wall surface.

In an exemplary embodiment, a method for operating a refrigeration system is provided. The method includes providing a storage chamber to store a product at a predetermined temperature, the storage chamber defined by an inner wall. The inner wall at least partially defines an air plenum. The inner wall includes an opening wall surface, a floor surface, a rear wall surface and a ceiling wall surface. A refrigerant circuit is provided that includes a compressor, a condenser, a condenser fan, an evaporator and an evaporator fan arranged and disposed in an operable configuration to provide refrigeration to the storage chamber. Air is conveyed from an air inlet, in the air plenum, across the evaporator and into a discharge chamber and out an air outlet. The air outlet is configured to discharge cooled air in a direction toward the opening wall surface.

In another exemplary embodiment, the air plenum arrangement and storage chamber are arranged and disposed to provide an enveloping airflow that travels from the air outlet of the air plenum along the opening wall surface, across the floor surface and into the air inlet of the air plenum.

Another aspect of this invention is greatly improved homogenization of ejected air. Temperature variation of the air passing over the evaporator is greatly reduced due to mixing forced in volumes where product cannot be stored.

Yet another aspect of this invention is the temperature moderation of ejected air at the exhaust. The temperature of the air passing over the evaporator is moderated and leaves the plenum at a temperature closer to the chamber temperature than it would otherwise.

Still another aspect of the invention is the cold surface cooling (as opposed to direct convective cooling) of upper storage chamber volume. The discharge chamber and upper surface of the storage chamber are cold due to the air coming directly from the evaporator fan. This cools the upper portions of the chamber via free convection and heat transfer directly from the plenum wall surface. This is important because the upper portions of a refrigerated chamber typically stay warmer than the mid and lower portions since warmer air naturally rises. This, in turn, improves chamber stability and uniformity in comparison to systems without this type of plenum.

Additionally, another aspect of this invention is the transient heat absorption effect due to the greater relative plenum area and inherent thermal mass of the surrounding plenum components combined with the interior walls of the refrigerator. Again, this serves to improve chamber stability and uniformity in comparison to systems without this type of air plenum.

Another important aspect of embodiments of the present disclosure is the relative elongation of the refrigeration system's intrinsic operating cycle period, resulting in fewer compressor starts per day required to maintain a defined differential. This is achieved without reducing the energy efficiency of the unit.

Also, a benefit of this invention is the enveloping of the product storage volume between a rear wall and a downward flow of cooling air at the front along the opening. Unlike conventional configurations, the front is cooled first rather than the rear and the air plenum provides an additional insulating effect further homogenizing temperature distribution.

Also, a benefit of this invention is the positive impact from the effective capacitive thermal mass heat exchange effect due to the enveloping circulation and the utilization of a greater portion of the refrigerator thermal mass after active refrigeration ceases. This works to continue passive cooling, moderate and slow temperature rise in the product chamber due to heat infiltration ultimately extending cycle times in comparison to conventional configurations, improving relative stability and uniformity without decreasing energy efficiency.

Importantly impacted by this invention is the time required to recover to the normal chamber operating ranges after long and short door openings. This is greatly enhanced due to the enveloping of the chamber, the increased effective capacitive thermal mass and the directed outlet and intake locations which counter the typical temperature gradient (driven by natural convection of warmer air) experienced in a refrigerated chamber.

Additionally, this invention reduces or eliminates the most common warm areas towards the front of the unit substantially impacting system stability and uniformity performance.

Important to this invention is the ability to maintain tight control of temperature variation using only conventional compressor systems vs. variable speed type compressor systems. The positive impact on the temperature variation is further improved by when variable speed type compressors are utilized.

Other features and advantages of the present invention will be apparent from the following more detailed description, taken in conjunction with the accompanying drawings which illustrate, by way of example, the principles of the invention.

BRIEF DESCRIPTION OF THE DRAWINGS

Wherever possible, the same reference numbers will be used throughout the drawings to represent the same parts.

DETAILED DESCRIPTION OF THE INVENTION

Provided is a refrigeration system that provides a benefit of exhausting air in a direction to the front of the unit rather than the rear and downwards causing the system to operate in a fundamentally different way because there is more room for air mixing, product cannot be positioned to block airflow and in turn temperature homogenization is improved.

The refrigeration system according to the present disclosure relates generally to the field of refrigeration for the storage of vaccines, blood products, food products, lab specimens and any application that requires tightly controlled temperature stability and uniformity. Temperature stability is defined as the largest temperature gradient experienced at a single point in the refrigerated chamber over a period of time. Temperature uniformity is defined as the maximum temperature experience across all points in the refrigerated chamber at any point in time during the testing period.

The disclosed method utilizes a novel air handling plenum that leverages intrinsic properties of the thermal system and construction to greatly improve the product chamber temperature uniformity and stability in comparison to systems with non-critical plenum designs or without plenums. Although this system manages airflow with an air plenum that specifically directs airflow, it is the novel leveraging of the entire thermal system and construction that achieves the performance improvements.

Important to the benefits provided by embodiments of the refrigeration system according to the present disclosure is the partial envelopment of the product chamber improving the uniformity and stability of the air temperature. The differentiators significantly impact the product chamber uniformity and stability parameters.

Embodiments of the present disclosure result in configurations that function in a superior way in comparison to all other known methodologies of homogenizing and stabilizing air temperatures employed in conventional (non-proportional) compressor driven, vapor cycle refrigeration systems. Such systems, employed in medical, pharmaceutical, food service and industrial applications generally rely on the same basic configuration and all have some measure of the issues inherent to such configurations.

Figure 1:
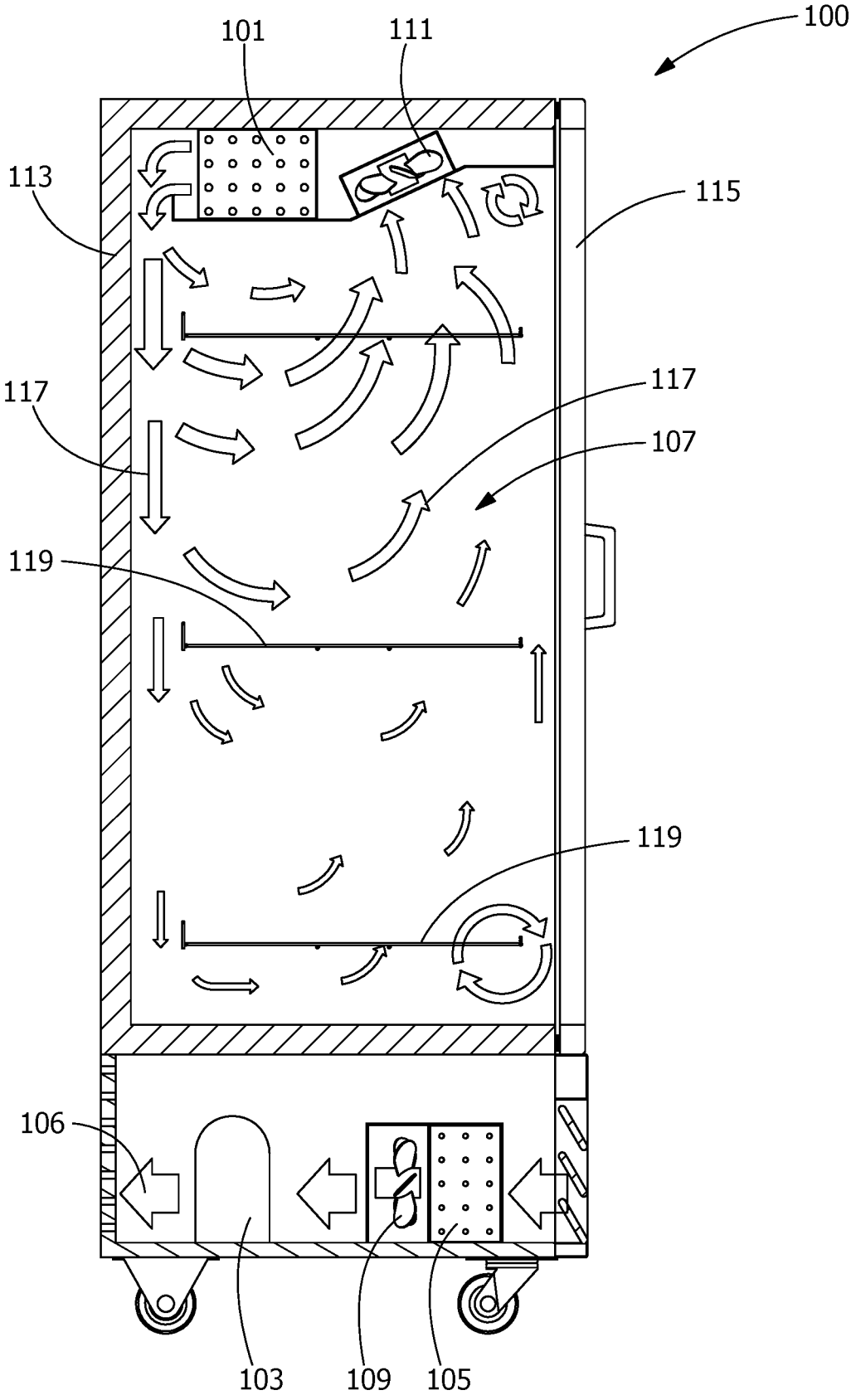
FIG. 1 shows a schematic view of a conventional refrigeration system and airflow pattern.
Figure 2:
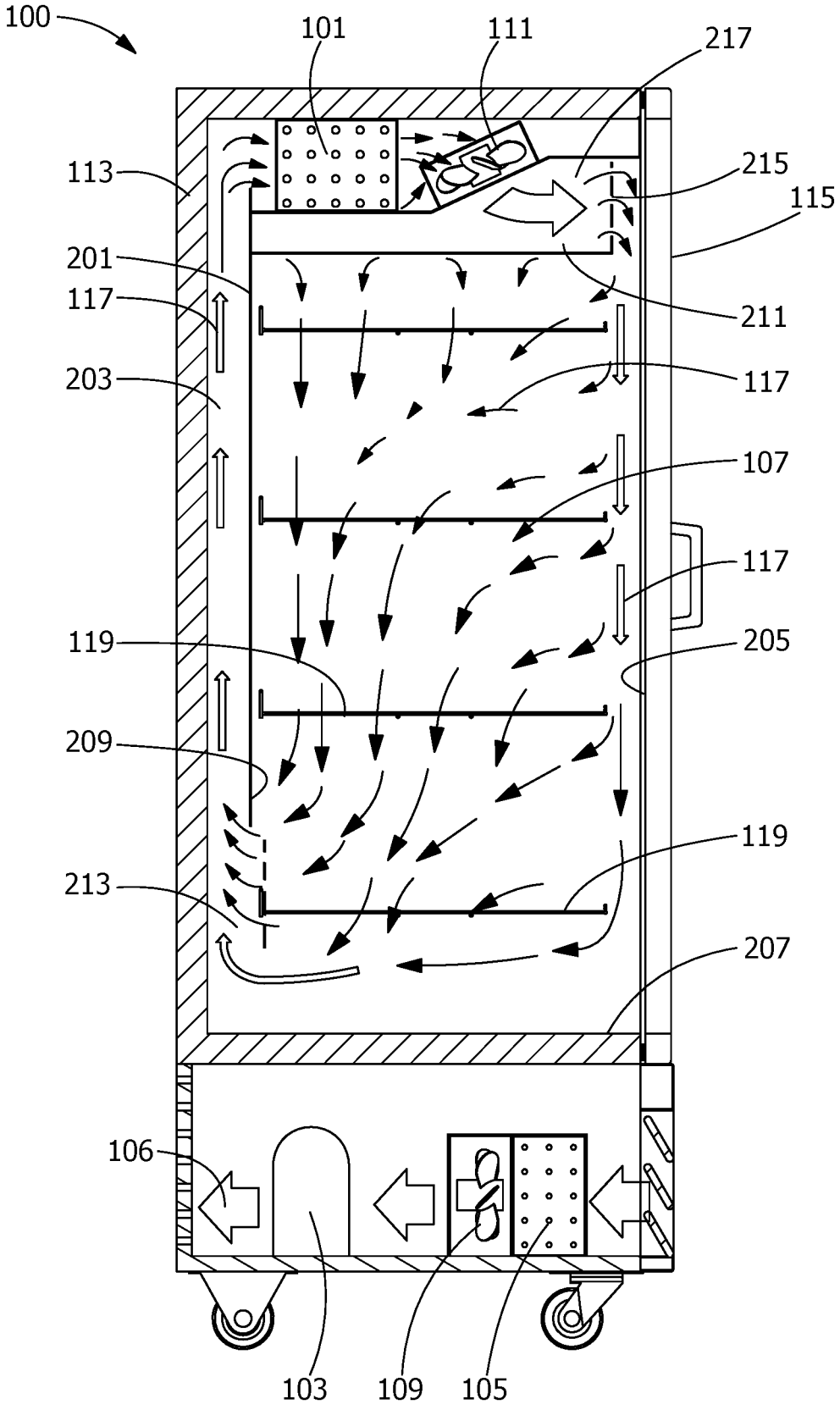
FIG. 2, shows a schematic view of a refrigeration system according to the present disclosure having an enveloping plenum configuration and airflow pattern, the refrigeration system being unloaded.

FIG. 2 shows a refrigeration system 100 according to an embodiment of the present disclosure. The refrigeration system 100 shown in FIG. 2 includes an evaporator 101, a compressor 103 and a condenser 105 in a refrigerant circuit that operate in essentially the same manner as shown and described in FIG. 1 to provide cooling to a storage chamber 107. In certain embodiments, the refrigerant circuit includes conventional and/or advanced components, such as proportional controllers and variable refrigeration effect vapor cycle type refrigeration systems. In one embodiment, the refrigerant circuit includes a vapor cycle refrigeration system having a non-proportional controller operating in a manner that meets or exceeds the temperature control and recovery requirements set forth in the NSF 456-2021 standard defining construction and temperature performance requirements for refrigerators and freezers used for storing vaccines. In one embodiment, the refrigerant circuit includes a vapor cycle refrigeration system having a parametric (non-proportional) digital controller that regulates the refrigeration system to operate within a set point and a temperature differential where the system will repeat the refrigeration cycle (setpoint plus the operational differential define the startup temperature for the compressor).

Unlike the system shown in FIG. 1, the embodiment of the present disclosure shown in FIG. 2 includes a storage chamber 107 defined by an inner wall 201, where the inner wall 201 at least partially defines an air plenum 203. The storage chamber 107 is an insulated chamber having opening 115 that is a solid or glass door having associated hardware. The storage chamber 107 and inner wall 201 may be formed from any suitable materials, such as, but not limited to, aluminum, stainless-steel components, plastic and other material known for use in refrigeration systems. The storage chamber 107 is preferably a compartment for storing a plurality of boxed vaccine vials, individual vaccine vials, blood or plasma products, laboratory specimens and samples or other product at a predetermined temperature variance as defined by the NSF 456-2021 standard or other applicable standards.

The inner wall 201 includes an opening wall surface 205, a floor surface 207, a rear wall surface 209 and a ceiling wall surface 211 all of which provide surfaces that bound the storage chamber 107. The air plenum 203 formed by the inner wall 201 corresponding to the rear wall surface 209 and the ceiling wall surface 211 conveys air from an air inlet 213 to an air outlet 215 across the evaporator 101 and the evaporator fan 111. The evaporator fan 111 in the embodiment of FIG. 2 is arranged to draw air across the evaporator 101 and discharge into a discharge chamber 217. The discharge chamber 217 creates a volume around the evaporator fan 111 to direct air forward into the front of the storage chamber 107 via air outlet 215. After mixing of the cooled air in the discharge chamber 217, the air is exhausted from the discharge chamber 217 into the storage chamber 107 via air outlet 215 in the direction of the opening wall surface and opening 115. The discharge chamber 217 separates the direct air ejection point at the air outlet 215 from the evaporator fan 111 and serves to homogenize the exiting airflow velocity distribution and create a cold ceiling wall surface 211 on the top of the storage chamber 107 enhancing radiant heat absorption and free convection into the upper volume of the storage chamber 107, enhancing thermal stability and uniformity of performance. As is demonstrated in FIGS. 7 and 8, the temperature stability and uniformity of the storage chamber 107 are significantly improved by the utilization of the enveloping plenum configuration according to embodiments of the present disclosure. Additionally, the cycle time is increased which reduces the number of compressor 103 starts required over the timeframe, reducing wear on the system and in turn increasing the anticipated reliability. The cooled ceiling wall surface 211 increases radiant heat exchange in the critical upper volume due to cold surface effect of the cooled upper plenum as this volume is important since it is typically the warmest volume in a refrigerator due to natural convection of warmer air. In addition, the cooled ceiling wall surface 211 increases free convection cooling off the upper plenum surface to cool upper volume. In one embodiment, the ceiling wall surface 211 is formed by an internal baffle arranged and disposed to reduce airflow losses and help prevent unwanted airflow into portions of the upper volumes of the storage chamber 107.

The configuration of refrigeration system 100 provides an air inlet 213 at the bottom of the storage chamber 107 causing an airflow that is counter to the natural convection of warmer air greatly enhancing uniformity though active mixing and counterflowing of cold and warm air currents. In one embodiment, the air inlet 213 intakes air through a plurality of vents in the bottom, rear of the storage chamber 107. In an exemplary embodiment, the distance from the celling wall surface 211 to the single or plurality of air inlet return openings 213 is two thirds to four fifths the height of the product storage chamber 107. In alternative embodiments, there is a step construction in the back wall of the product storage chamber 107 and the distance from the celling wall surface 211 to the single or plurality of air inlet return openings 213 is one half the height of the product storage chamber 107. In addition, the embodiments of the present disclosure eliminate the ejection of cold air along the back wall to the bottom of the chamber where the cold exiting air reinforces the cold air naturally residing at the back rear of the unit. The conventional rear, downward cold air ejection exacerbates the naturally cold regions (colder air naturally falls). This elimination, as is present in the embodiments of the present disclosure, serves to better homogenize the temperature distribution within the chamber. In addition, the embodiments of the present disclosure direct air from the top, front of the chamber to the bottom portion of the rear of the chamber homogenizing temperature variances in the storage chamber 107. This greatly reduces unwanted recirculation effects common in conventional configurations that limits air exchange in the lower volumes, particularly when the chamber is loaded with product. In one embodiment, the air outlet 215 ejects air forward towards the opening 115 of the refrigeration system 100 though a plurality of vents at the top of the chamber no farther than 12 inches from the door and no closer than ½ inch from the opening 115.

Also shown in FIG. 2, the resulting airflow 117 shows air circulation within the storage chamber 107 and through air plenum 203. The airflow 117 shown in FIG. 2 demonstrates some of the beneficial impacts of the described invention to leverage the characteristics of the refrigerator construction and configuration to enhance stability and uniformity performance parameters. For example, the induced airflow in storage chamber 107 counters the direction of natural convection causing immediate mixing of the cold exiting air with the warm air rising up along the length of opening 115, which is typically the warmest surface in the storage chamber 107. Airflow exiting the discharge chamber 217 and out air outlet 215 and down the opening wall surface 205 provides an enveloping airflow that travels from the air outlet of the air plenum along the opening wall surface, across the floor surface and into the air inlet of the air plenum. In one embodiment, the enveloping airflow envelops at least ½ of the storage chamber as measured perpendicular to the opening wall surface, the floor surface, the rear wall surface and the ceiling wall surface. In one embodiment, the enveloping airflow envelops at least ½ of the volume of the storage chamber. In one embodiment, the air inlet 213 is positioned at least ½ of the distance down the rear wall surface as measured perpendicular to the ceiling wall. In one embodiment, the enveloping air flow cannot easily have interference due to product on shelves 119 since the shelves 119 are spaced from the opening wall surface 205 to keep the product recessed within the chamber when the door is opened (see, for example, FIG. 3). The air inlet 213 and the air outlet 215 are significantly separated preventing unwanted recirculation and cause flow directionality to enhance uniform mixing and much higher storage chamber air velocities than would a conventional configuration. In addition, the configuration of the refrigeration system 100 according to the present disclosure improves exiting air uniformity to achieve more direct mixing of the cold air exiting the air plenum and the warmer air that naturally convects to the top-front of the storage chamber 107. In addition, embodiments of the present disclosure provide larger volume for the mixing of cold exiting air and warmer, rising air than conventional designs and eliminates the inherent warm air concentration in the upper volume common in conventional designs that intake air at the top of the storage chamber 107.

Embodiments of the present disclosure are adaptable and retrofittable to common, conventional refrigerator configurations via reversal of flow direction and incorporation of inner wall 201 components to form an air plenum on systems having an evaporator located in the top and ejecting air down the rear wall.

Figure 3:
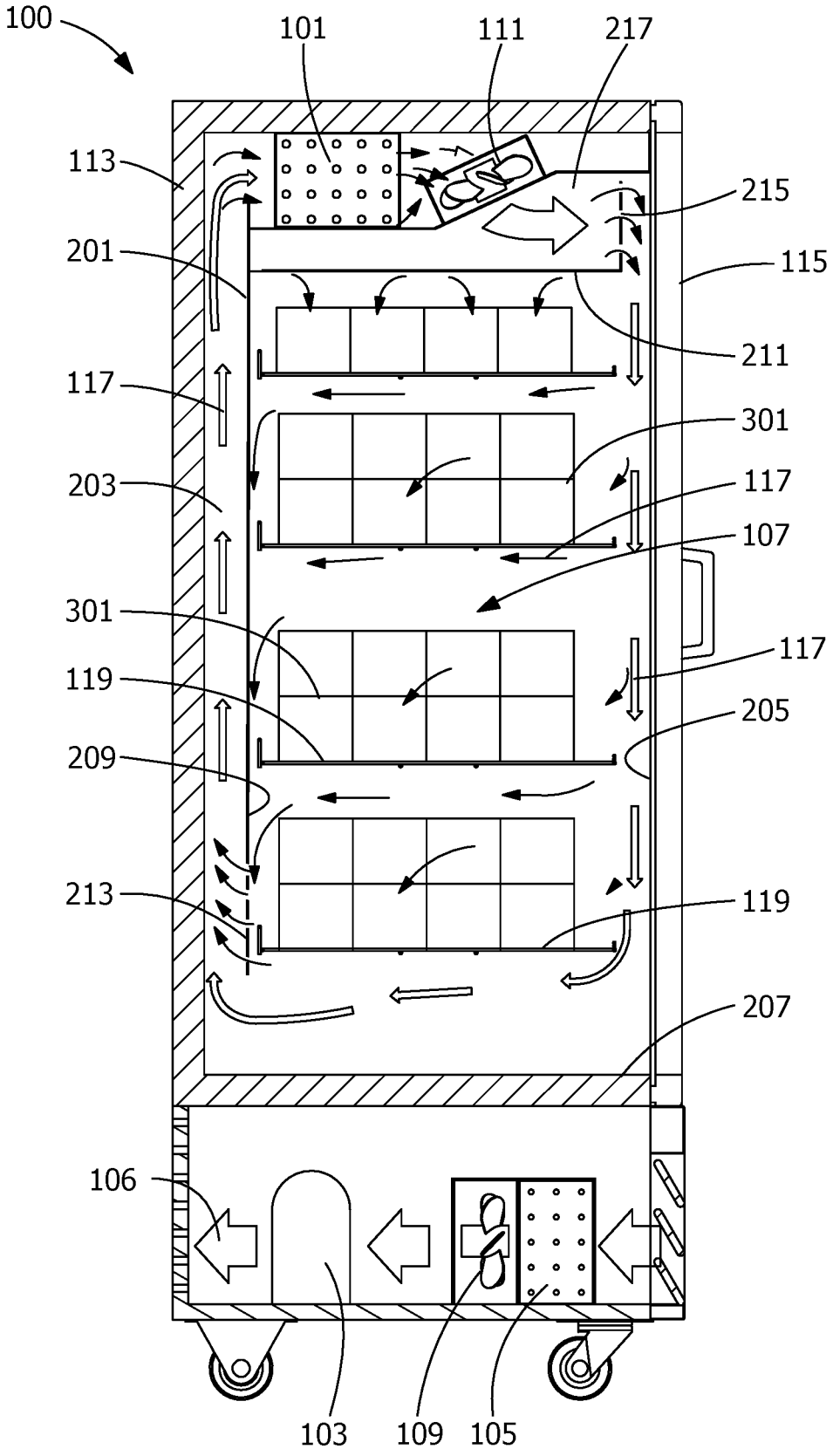
FIG. 3, shows a schematic view of a refrigeration system according to the present disclosure having an enveloping plenum configuration and airflow pattern, the refrigeration system being loaded with product.

FIG. 3 shows a refrigeration system 100 according to an embodiment of the present disclosure having the same configuration of FIG. 2. In FIG. 3, the storage chamber 107 is loaded with product 301. FIG. 3 graphically demonstrates the beneficial impact of the described invention when the product chamber is heavily loaded. Product 301 is stored on the shelves but has little or no interference with the airflow 117 as product 301 is stored at the rear of the unit for conventional configurations with a space in the front of the system 100 due to the positioning of shelves 119. Airflow velocity across the stored product 301 is reduced relative to the unloaded scenario but the enveloping effect is amplified since a greater portion of the airflow travels down the opening wall surface 205 and returns to the air plenum 203 via air inlet 213. This beneficial airflow enhances uniformity and stability due to the creation of an enveloping effect that surrounds the product with a highly stable airflow with high velocity and low temperature variance.

Figure 4:
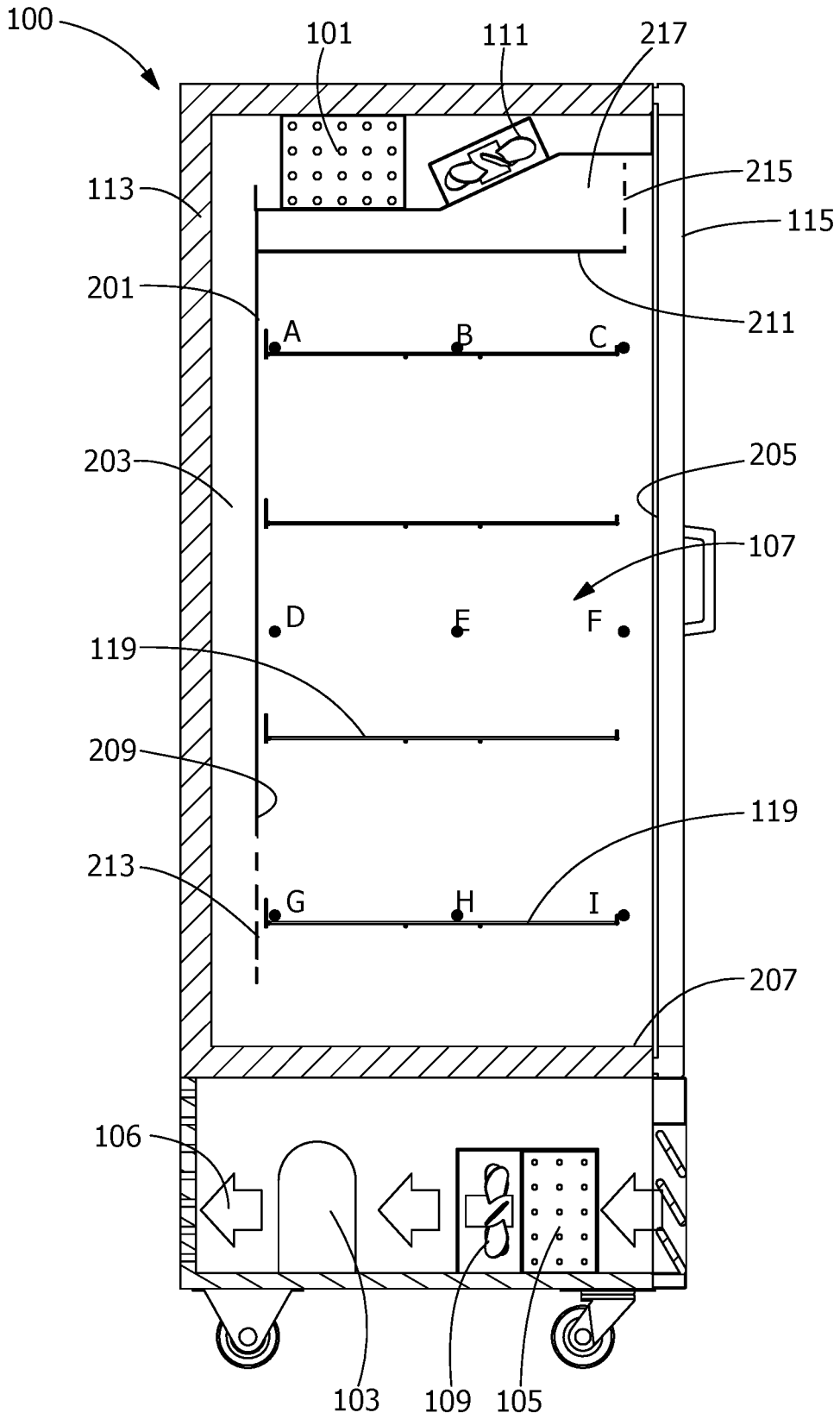
FIG. 4, shows a schematic view of a refrigeration system according to the present disclosure having an enveloping plenum configuration and airflow pattern, the refrigeration system showing test point locations.
Figure 7:
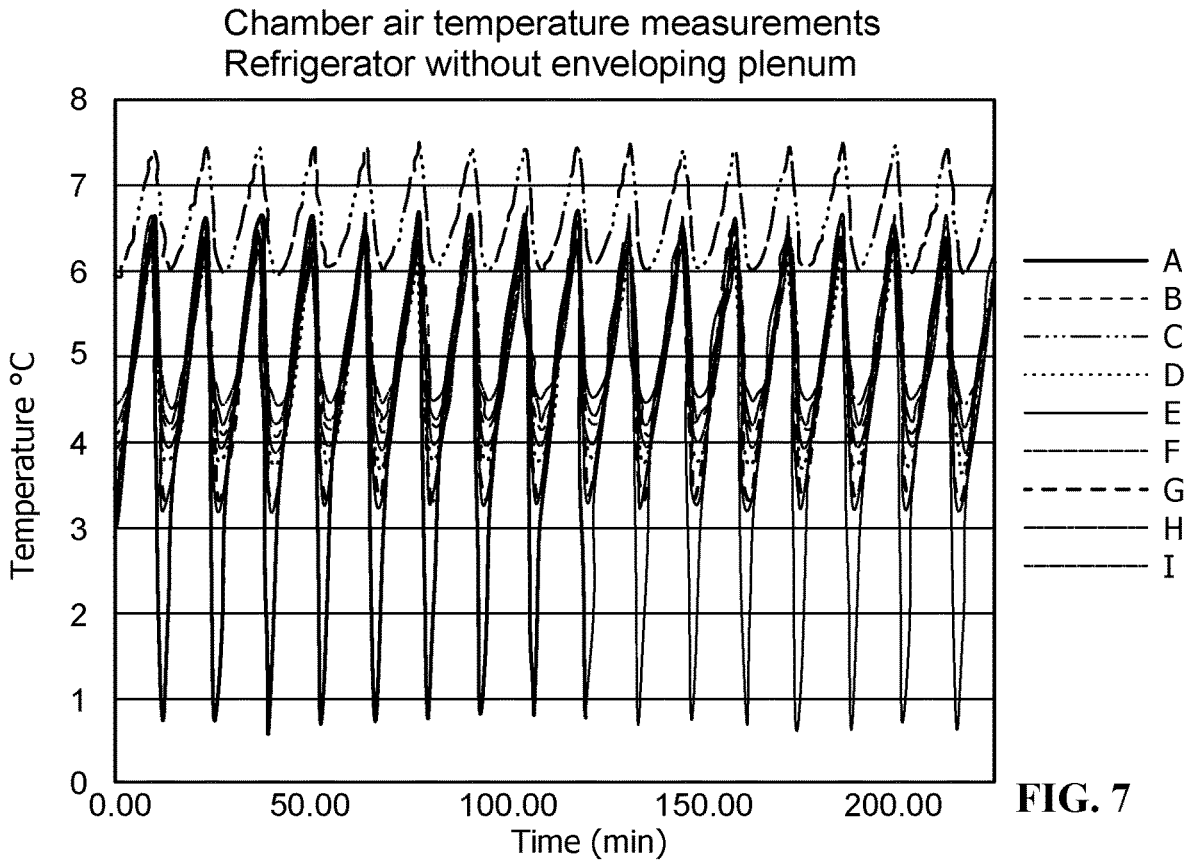
FIG. 7, show a plot of refrigerated chamber temperature measurements vs. time for a refrigerator not employing an enveloping plenum.
Figure 8:
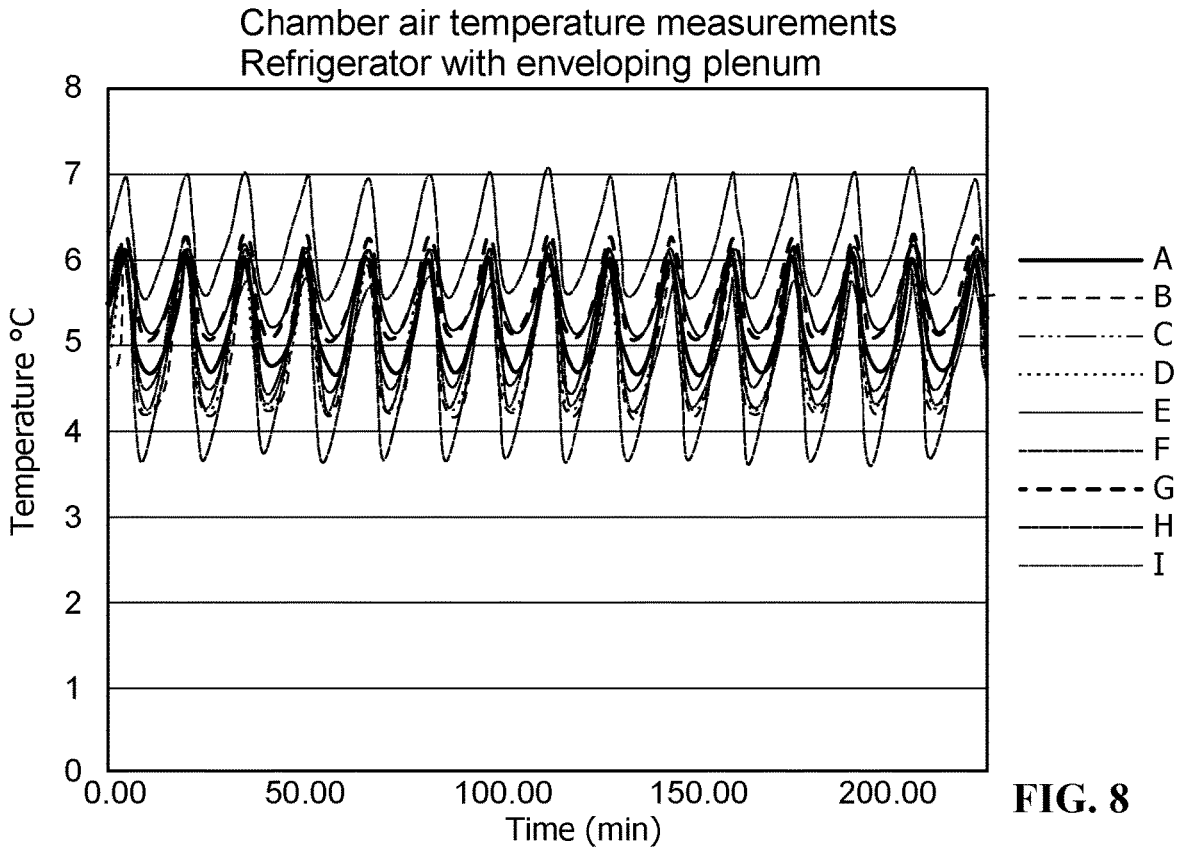
FIG. 8, shows a plot of refrigerated chamber temperature measurements vs. time for a refrigerator employing an enveloping plenum.

FIG. 4, shows a refrigeration system 100 according to an embodiment of the present disclosure having the same configuration of FIG. 2. FIG. 4 provides exemplary positioning of temperature probe locations used to determine stability and uniformity performance. Referencing FIG. 1 and comparing airflow direction and local volumetric flow (indicated by varying arrow size) the following observations can be made using data generated for the individual probe locations. Although there are variations when considering the 3D volume, the 2D representation shows substantial improvement in heat absorption, thermal stability and uniformity of performance of system 100. FIG. 7, demonstrates performance of a refrigerator without an enveloping plenum accordingly to the arrangement shown and described with respect to FIG. 1. FIG. 8, shows the same refrigerator with an enveloping plenum and identical system settings. The overall temperature stability is improved by approximately 100% and the uniformity by 300%.

Figure 5:
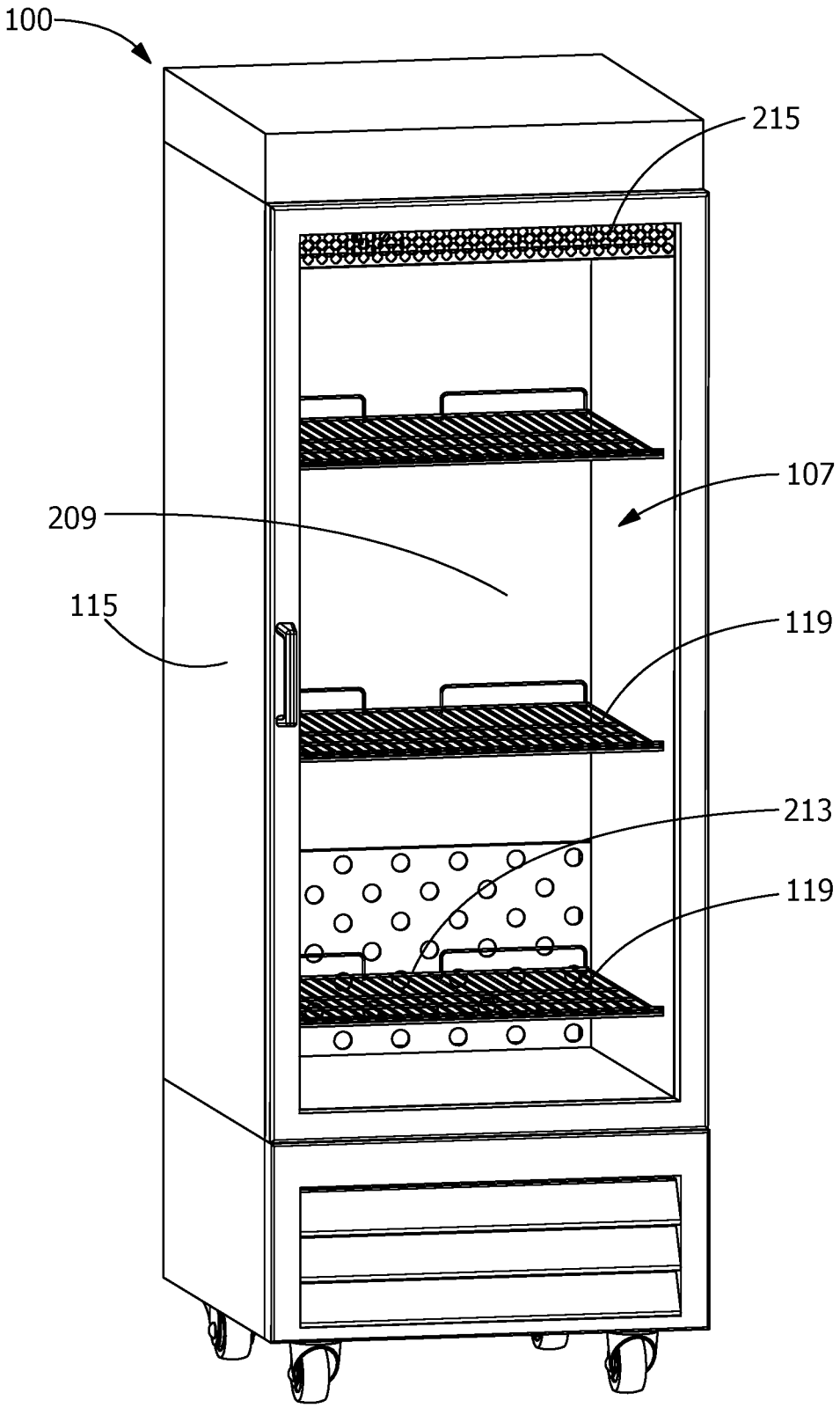
FIG. 5, shows a front perspective view of a refrigeration system according to the present disclosure having an upper plenum exhausting towards the opening, the refrigeration system being unloaded.
Figure 6:
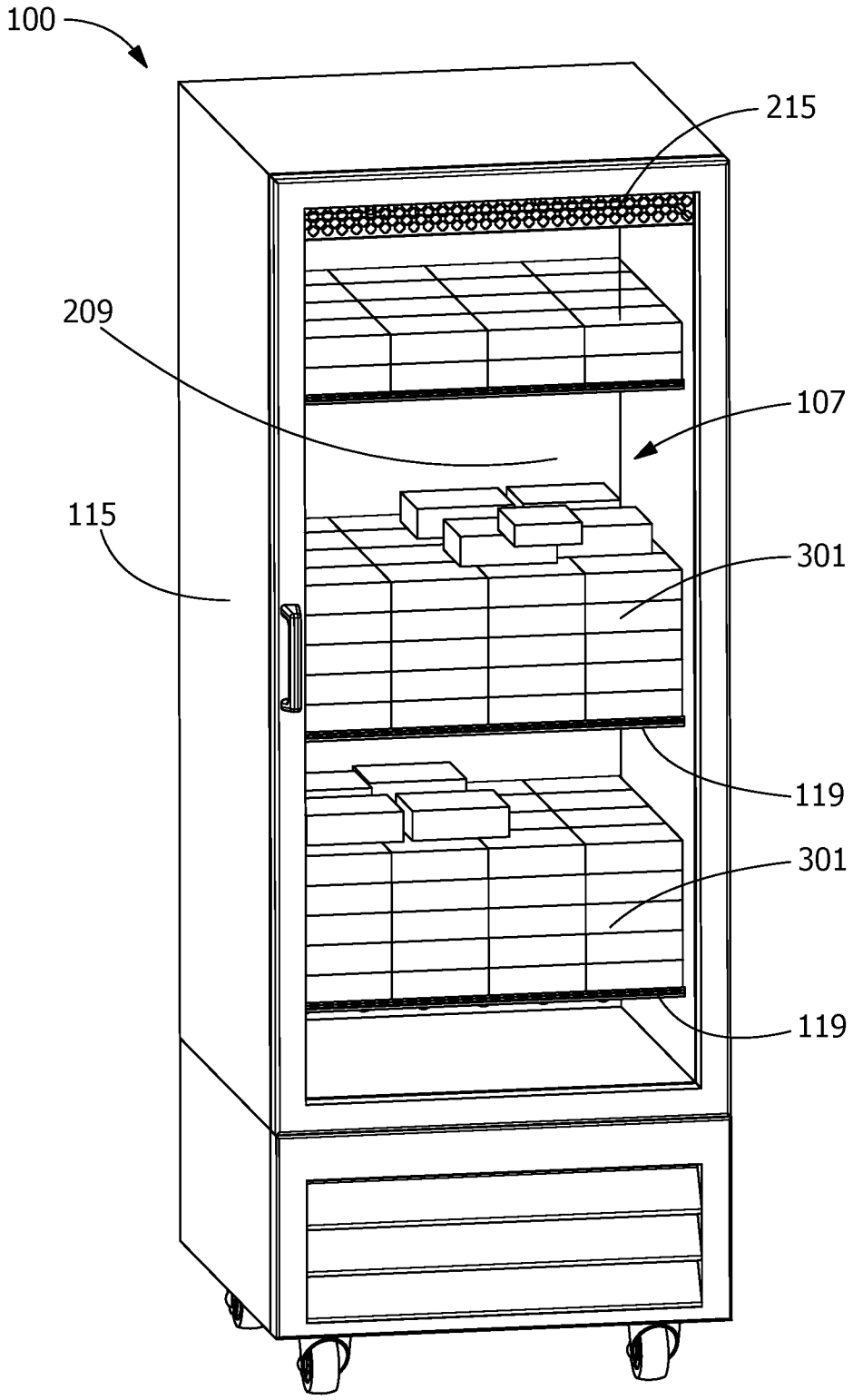
FIG. 6, shows a front perspective view of a refrigeration system according to the present disclosure having an upper plenum exhausting towards the opening, the refrigeration system being loaded with product.

FIG. 5, shows a refrigeration system 100 according to an embodiment of the present disclosure having the same configuration of FIG. 2. FIG. 5 shows air outlet 215, which discharges air in the direction toward the opening 115. Also visible in FIG. 5 are shelves 119 positioned to permit the enveloping air flow. In addition, rear wall surface 209 is visible, which houses a portion of air plenum 203 (not visible in FIG. 5). The air inlet 213 is located at the base of rear wall surface 209 and receives air circulated in storage chamber 107. FIG. 6, shows the refrigerator system of FIG. 5 loaded with product 301.

The arrangement according to the present disclosure, as exemplified in FIGS. 2-6, provides a temperature recovery after a short door opening (defined as less than 8 seconds) that is greatly enhanced due to the cold air ejection towards the front of the unit and the greater heat capacity utilization between refrigeration cycles. When a door is opened, the refrigerated air flows out of the unit and is replaced with warmer air from the ambient environment. Conventional systems have greater temperature spikes and a long delay to recover from the infiltration of warm air since there is less capacitive heat utilization and the cold air exiting the evaporator must travel a very long distance and heat up significantly before the upper front volume is affected. In contrast, the described embodiment, as shown in FIGS. 2-6, immediately floods the front upper volume, mixes with the warm air and very quickly recovers to within the normal operating temperatures.

In addition, the arrangement according to the present disclosure, as exemplified in FIGS. 2-6, provides a temperature recovery after a long door opening (defined as greater than 120 seconds) is improved upon in comparison to conventional configurations due to the effect of the forward ejecting evaporator air (as described above) and the relatively high flow velocities and counter convection mixing created in the critical front and upper volumes due to the separation of the exhaust air and the intake air. Again, the flow being counter to the natural convective tendency and the inherent cold to warmer gradient back to front in the unit is intrinsically countered by the invention described.

While the invention has been described with reference to one or more embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims. In addition, all numerical values identified in the detailed description shall be interpreted as though the precise and approximate values are both expressly identified.

What is claimed is:

1. A refrigeration system comprising:

a storage chamber configured to store a product at a predetermined temperature, the storage chamber defined by an inner wall, the inner wall at least partially defining an air plenum, the inner wall including an opening wall surface, a floor surface, a rear wall surface and a ceiling wall surface;

a refrigerant circuit including a compressor, a condenser, a condenser fan, an evaporator and an evaporator fan arranged and disposed in an operable configuration to provide refrigeration to the storage chamber;

wherein the air plenum includes a conduit arranged and disposed to convey air from an air inlet across the evaporator and into a discharge chamber and out an air outlet, the air outlet being configured to discharge cooled air in a direction toward the opening wall surface and being positioned at the top of the storage chamber no farther than 12 inches from the opening wall surface and no closer than ½ inch from opening wall surface.

2. The system of claim 1, wherein the air plenum arrangement and storage chamber are arranged and disposed to provide an enveloping airflow that travels from the air outlet of the air plenum along the opening wall surface, across the floor surface and into the air inlet of the air plenum.

3. The system of claim 2, wherein the enveloping airflow envelops at least ½ the volume of the storage chamber.

4. The system of claim 1, wherein the discharge chamber is positioned downstream from the evaporator fan and upstream from the air outlet.

5. The system of claim 1, the opening wall surface includes an inwardly facing surface of an opening that includes a solid or transparent door.

6. The system of claim 1, wherein the refrigeration circuit includes a non-proportional controller operating in a manner that meets or exceeds the temperature control and recovery requirements set forth in the NSF 456-2021 standard defining construction and temperature performance requirements for refrigerators and freezers used for storing vaccines.

7. The system of claim 1, wherein the refrigeration circuit includes a parametric (non-proportional) digital controller that regulates the refrigeration system to operate within a set point and a temperature differential where the system will repeat the refrigeration cycle.

8. The system of claim 1, wherein the product includes a plurality of individual bottles of vaccine or boxes containing a plurality of bottles at a predetermined temperature variance as defined by the NSF 456-2021 standard.

9. The system of claim 1, wherein the refrigeration circuit includes proportional controllers and variable refrigeration effect vapor cycle type refrigeration systems.

10. The system of claim 1, wherein the inner wall is formed of a material selected from the group consisting of aluminum, stainless-steel components, plastic and combinations thereof.

11. The system of claim 1, wherein the ceiling wall surface is arranged and disposed to reduce airflow losses and help prevent unwanted airflow into portions of the upper volumes of the storage chamber.

12. The system of claim 1, wherein the refrigeration system is a retrofitted refrigerator.

13. A method for operating a refrigeration system comprising:

providing a storage chamber to store a product at a predetermined temperature, the storage chamber defined by an inner wall, the inner wall at least partially defining an air plenum, the inner wall including an opening wall surface, a floor surface, a rear wall surface and a ceiling wall surface;

providing a refrigerant circuit including a compressor, a condenser, a condenser fan, an evaporator and an evaporator fan arranged and disposed in an operable configuration to provide refrigeration to the storage chamber;

conveying air from an air inlet, in the air plenum, across the evaporator and into a discharge chamber and out an air outlet, the air outlet being configured to discharge cooled air in a direction toward the opening wall surface;

discharging cooled air in a direction toward the opening wall surface through the air outlet, the air outlet being positioned at the top of the storage chamber no farther than 12 inches from the opening wall surface and no closer than ½ inch from opening wall surface.

14. The method of claim 13, further comprising forming an enveloping airflow that travels from the air outlet of the air plenum along the opening wall surface, across the floor surface and into the air inlet of the air plenum.

15. The method of claim 14, wherein the enveloping airflow envelops at least ½ the volume of the storage chamber.

16. The method of claim 13, wherein the air plenum includes an internal baffle arranged and disposed to reduce airflow losses and help prevent unwanted airflow into portions of the upper volumes.

17. The method of claim 13, wherein the refrigeration system is a retrofitted refrigerator.

* * * * *